US005465831A

United States Patent [19]

Smith

[11] Patent Number: 5,465,831

[45] Date of Patent: Nov. 14, 1995

[54] TRANSPORT/DISPLAY PACKAGE

[75] Inventor: Jeffrey A. Smith, Clark, N.J.

[73] Assignee: Squire Corrugated Container Corp., Linden, N.J.

[21] Appl. No.: 319,432

[22] Filed: Oct. 6, 1994

[51] Int. Cl.[6] ..... B65D 5/52

[52] U.S. Cl. ..... 206/44 R; 206/44.11; 206/45.12

[58] Field of Search ..... 206/44 R, 44.11, 206/44.12, 45.12; 229/101.1, 200

[56] References Cited

U.S. PATENT DOCUMENTS 1,911,678 5/1933 Dunn, Jr. ..... 206/44.11
3,315,875 4/1967 Praetorius ..... 206/44.12
3,669,251 6/1972 Phillips, Jr. ..... 206/45.12
4,116,330 9/1978 Ellis ..... 206/45.12
4,396,115 8/1983 Watson ..... 206/44 R

*Primary Examiner*—David T. Fidei
*Attorney, Agent, or Firm*—Kirschstein et al.

[57] ABSTRACT

A cover is removed from a package in order to convert the package from a transport condition to a display condition. The cover has a detachable, tear-off top part which, when detached from a top wall, forms a top opening and a front opening, both of which are exposed in order to prominently view articles within the package.

8 Claims, 3 Drawing Sheets

TRANSPORT/DISPLAY PACKAGE

BACKGROUND OF THE INVENTION

1. Field of the Invention

This invention generally relates to a package for protecting articles from shipping and handling damage in a transport condition and for prominently displaying the articles in a display condition, and, more particularly, to a package readily convertible from the transport condition to the display condition.

2. Description of the Related Art

In order to withstand the impact forces encountered during shipping and handling without transmitting excessive amounts of such forces to articles packaged within a transport package, the packaging is typically constituted of a corrugated board material with or without packaging materials such as loose fill, rigid but deformable inserts, inflatable inserts, etc. Upon arrival at a retail site, the packaging materials are removed, and the articles are typically stacked, for display purposes, either on built-in store shelving or on stand-alone displays. Stacking the articles is a time-consuming, costly procedure. Displaying the articles in their original packages is not only unaesthetic, but also unsatisfactory from a retailing viewpoint, since the articles are not prominently displayed, and for the most part are hidden in their original packages.

SUMMARY OF THE INVENTION

Objects of the Invention

It is a general object of this invention to advance the state of the packaging art.

Another object of this invention is to not only reliably protect articles from damage during their transport, but also to prominently display the articles during their display in a single package.

An additional object of this invention is to readily convert a single package from a transport condition to a display condition.

Features of the Invention

In keeping with these objects and others which will become apparent hereinafter, one feature of this invention resides, briefly stated, in a package which is convertible from a transport condition to a display condition. The package includes an upright, generally planar, back wall. The package further includes a pair of generally planar, top and bottom walls extending in mutual parallelism along a longitudinal direction away from the back wall. The bottom wall is longer than the top wall. The package further includes a pair of upright, generally planar, side walls extending between the top and bottom walls in mutual parallelism along a transverse direction generally perpendicular to the longitudinal direction.

In accordance with this invention, an inclined, generally planar, front wall extends between the side walls. The front wall also extends from the bottom wall at an acute angle of inclination in a direction generally toward the back wall and the top wall. The front wall terminates short of the top wall to bound a front opening.

The invention further includes a cover having a bottom part at least partly overlying the bottom wall in the transport condition, a front part overlying the front opening and the front wall in the transport condition, and a detachable top part generally co-planar with the top wall in the transport condition and detached from the top wall to form a top opening in the display condition. The cover is removable from the package to expose both the top and front openings.

Thus, in accordance with this invention, the same package is readily converted from the transport condition to the display condition by removing the cover. In the transport condition, the package is completely enclosed, thereby protecting the articles within from shipping and handling damage. In the display condition, the exposed top and front openings ensure that the articles are prominently displayed. The articles are easily removable through the exposed front and top openings, and the front wall assists in maintaining the lowermost articles in an upright stack within the package, even as the uppermost articles are removed from the stack.

In the preferred embodiment, the top part of the cover is connected to the top wall along a discontinuous score line. The bottom, front and top parts are integrally hinged. The angle of inclination lies in a range from about 50° to about 80° relative to the bottom wall.

In the preferred commercial embodiment, the bottom wall has a pair of slots, and the bottom part has a pair of flaps that are inserted and frictionally held in the slots in the transport condition. The bottom part may also be provided with a finger notch to facilitate removal of the cover. In addition, a slit is formed in the bottom wall. The front wall is constituted of a pair of front wall portions folded about a fold line. One of these front wall portions has a projection for insertion into the slit.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
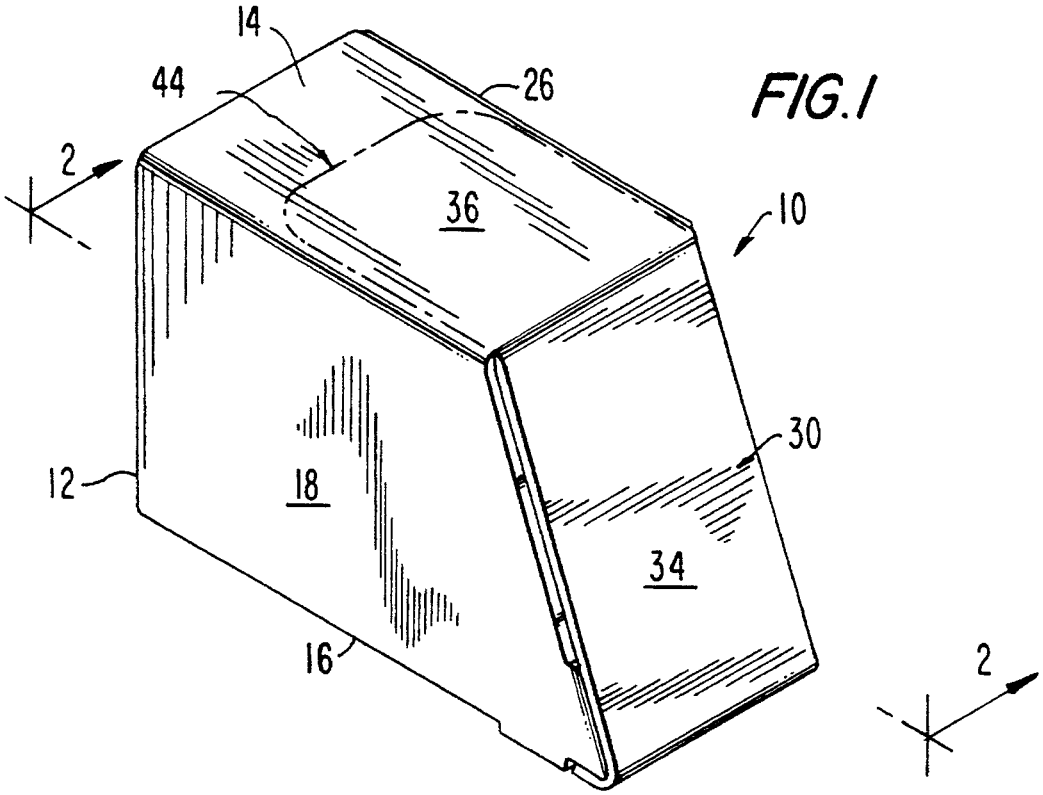
FIG. 1 is a perspective view of a package in accordance with this invention in a transport condition.
Figure 2:
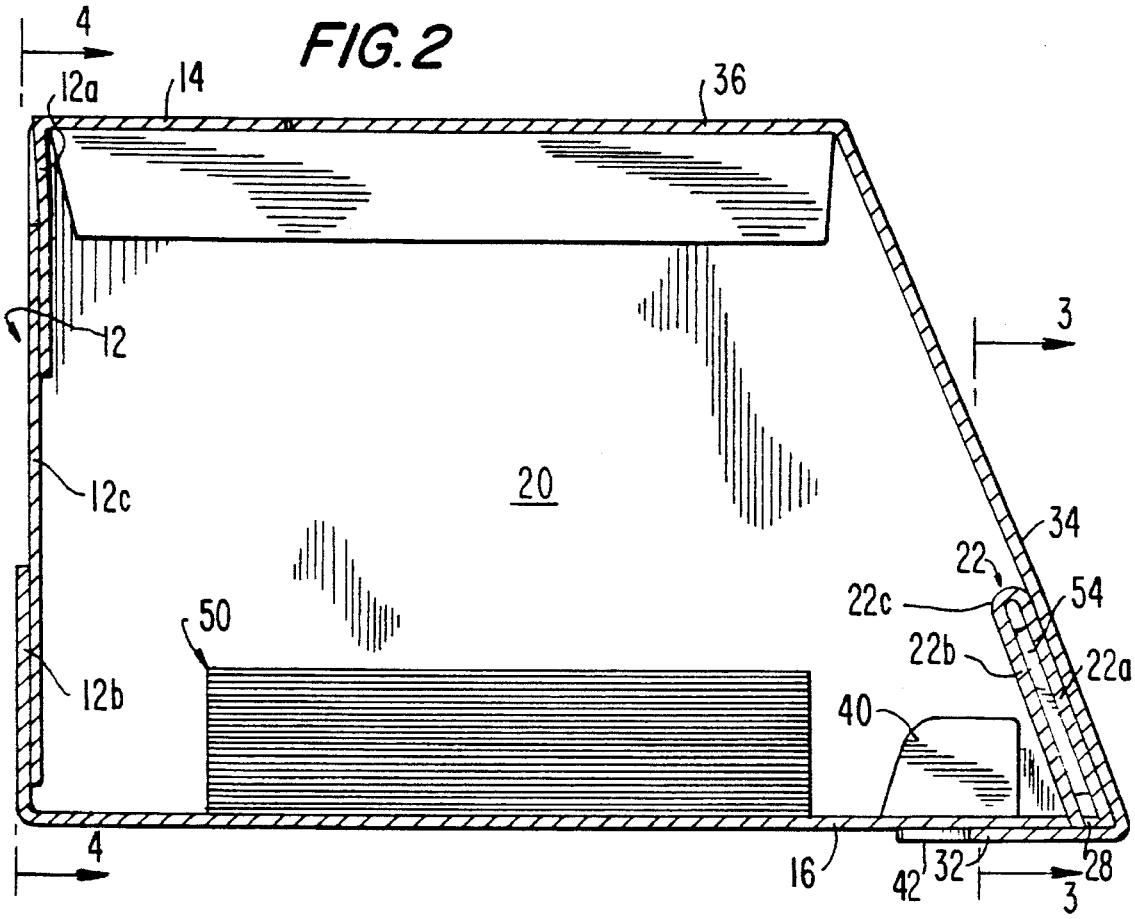
FIG. 2 is an enlarged, sectional view taken on line 2—2 of FIG. 1.
Figure 3:
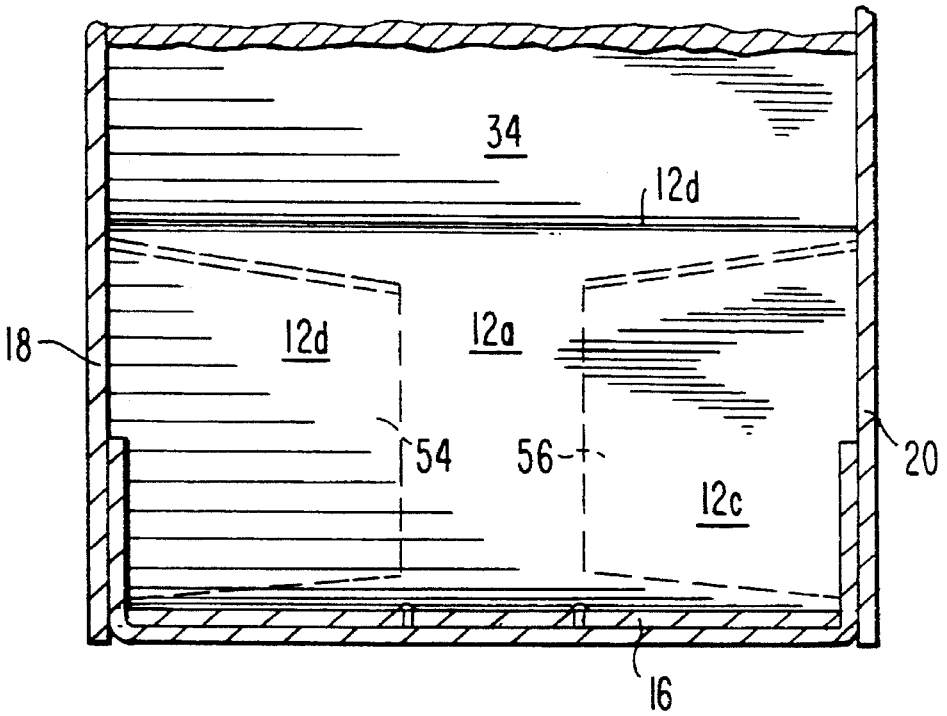
FIG. 3 is a sectional view taken on line 3—3 of FIG. 2.
Figure 4:
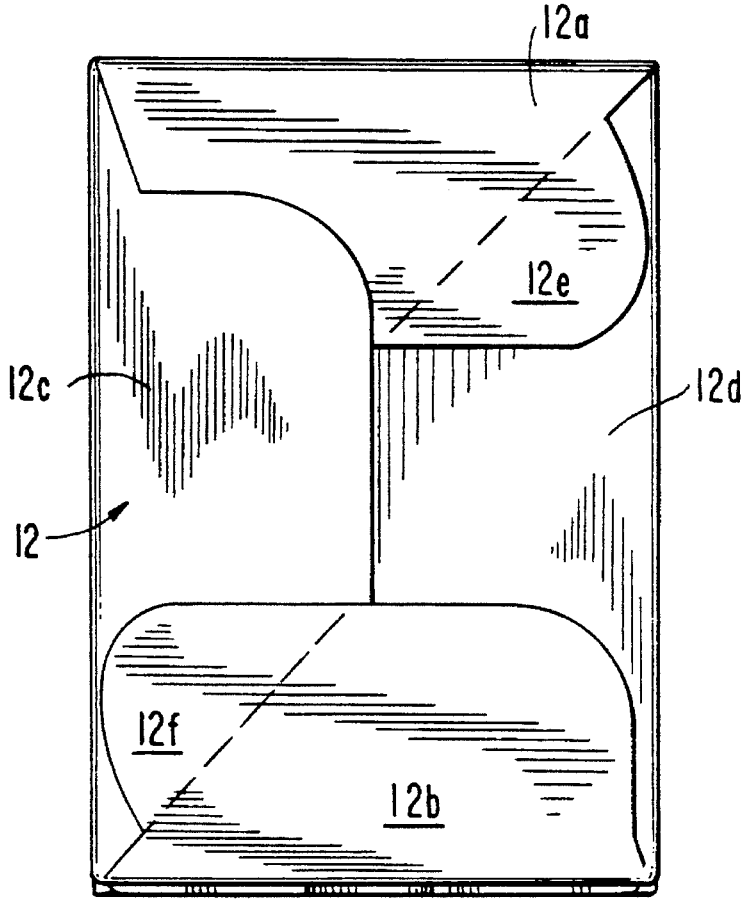
FIG. 4 is a rear elevational view taken on line 4—4 of FIG. 2.
Figure 5:
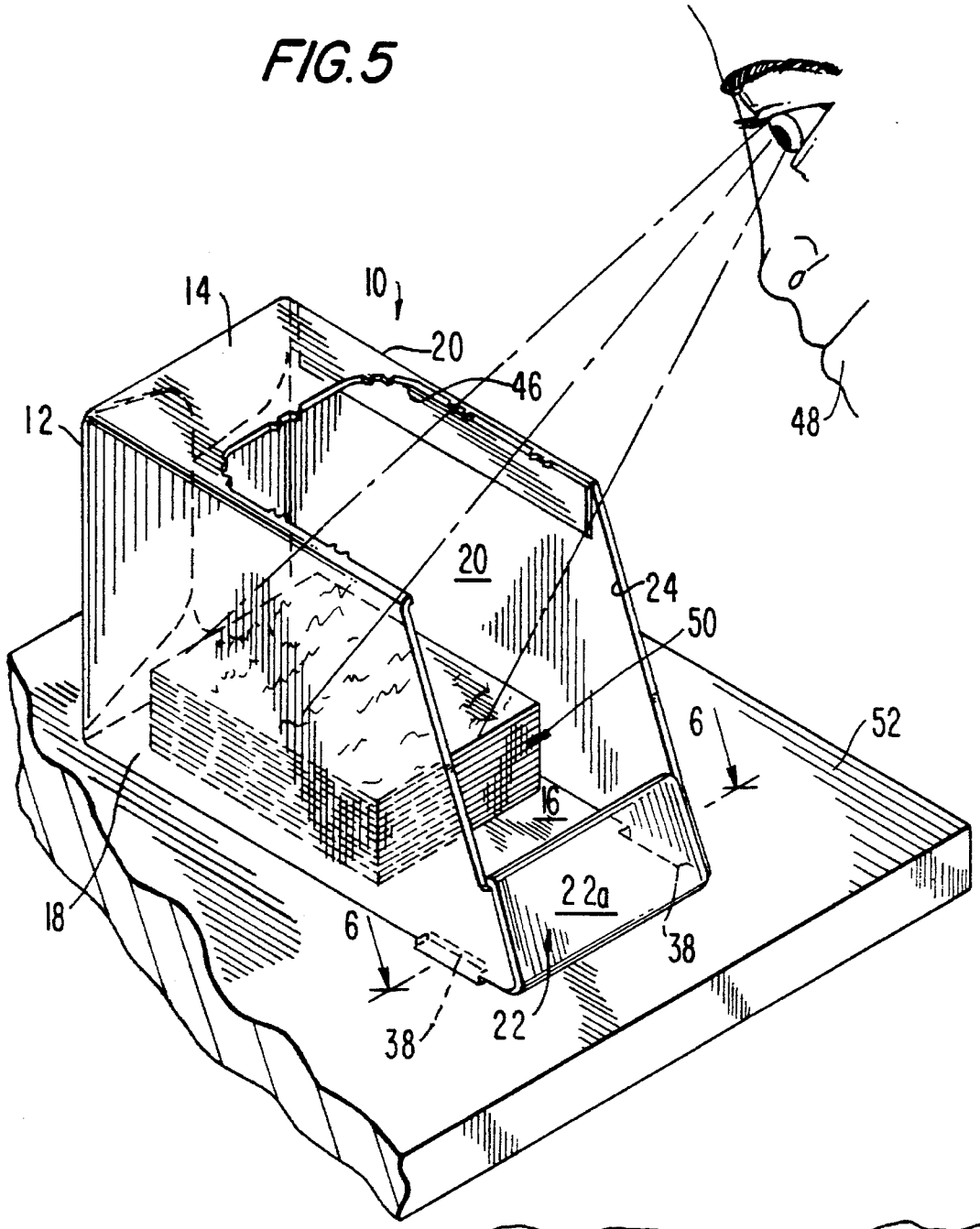
FIG. 5 is a perspective view of the package of FIG. 1 after being converted to a display condition.
Figure 6:
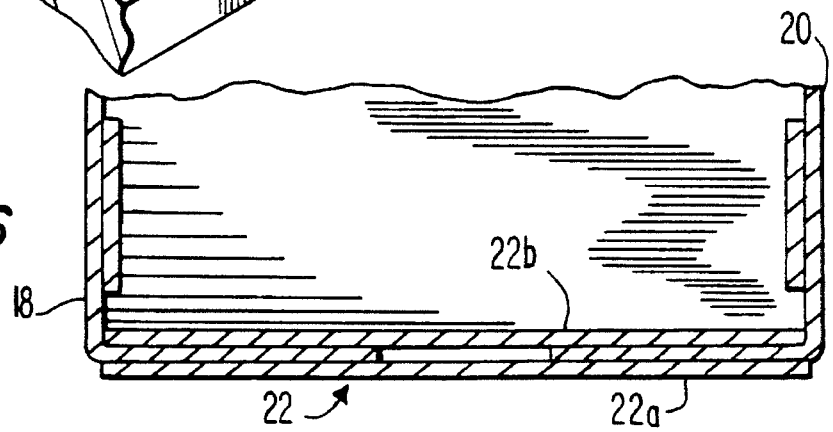
FIG. 6 is a broken-away, sectional view taken on line 6—6 of FIG. 5.

Referring now to the drawings, reference numeral 10 generally identifies a transport/display package convertible from a transport condition (FIG. 1) to a display condition (FIG. 5). Package 10 includes an upright, generally planar, back wall 12 composed of four flaps 12*a*, 12*b*, 12*c* and 12*d* (see FIG. 4). Flaps 12*a* and 12*b* have sections 12*e*, 12*f* that are respectively adhered to flaps 12*d* and 12*c* in order to close the back wall.

Package 10 further includes a pair of generally planar, top and bottom walls, 14, 16 extending in mutual parallelism along a longitudinal direction away from the back wall 12. The bottom wall 16 is longer than the top wall 14. A pair of upright, generally planar, side walls 18, 20 extends between the top and bottom walls in mutual parallelism along a transverse direction generally perpendicular to the longitudinal direction.

An inclined, generally planar, front wall 22 extends between the side walls 18, 20 along the transverse direction. The front wall 22 also extends at an acute angle of inclination away from the bottom wall in a direction generally toward the back wall and the top wall. The angle of inclination lies preferably in a range from about 50° to about 80°. The front wall 22 terminates short of the top wall to bound a front opening 24. The front wall 22 is of double ply construction and has a pair of front wall portions 22*a*, 22*b* foldable about a fold line 22*c* into overlapping relationship. Front wall portion 22*b* has a projection 26 that is inserted into, and is frictionally held within, a slot 28 formed through the bottom wall 16.

The package 10 includes a cover 30 having a bottom part 32 which at least partly overlaps the bottom wall 16 in the transport condition, a front part 34 that overlies the front opening 24 and the front wall 22 in the transport condition, and a detachable top part 36 that is generally co-planar with the top wall 14 in the transport condition. The bottom 32, front 34 and top 36 parts are integrally hinged with each other. The bottom wall 16 has a pair of slots 38, and the bottom part 32 has a pair of flaps 40 that are inserted into, and are frictionally held within, the slots 38 in the transport condition. The bottom part 32 is also provided with a finger notch 42 to facilitate the removal of the cover.

A discontinuous score line 44 bounds the top part 36. By engaging the finger notch 42 and pulling the flaps 40 out of their slots 38, the bottom part 32 is moved away from the bottom wall 16. Thereupon, by lifting upwardly on the cover 30, the front part 34 is removed from its overlying relation with the front panel 22 and the front opening 24. Next, by pulling upwardly and rearwardly on the cover 30, the top part 36 is torn along the score line 44 and detached from the top wall 14, thereby forming a top opening 46 in the space formerly occupied by the top part 36.

As shown in FIG. 5, in the display condition of the package 10, both the top opening 46 and the front opening 24 are both exposed, thereby allowing a consumer 48 to view articles 50 contained in a stack within the package. The articles 50 are viewable both from above and from the front of the package. This visibility is especially good when the package is mounted on a shelf 52 that is located at a low elevation relative to the ground. The consumer can readily remove uppermost articles in the stack, while the lowermost articles are neatly contained and held in place by the front wall 22.

In the preferred commercial embodiment, the package is entirely constituted of corrugated board. All of the walls, except for the side walls, are generally rectangular in shape. The side walls 18, 20 have a right trapezoidal shape. The side walls 18, 20 also have inner generally rectangular flaps 54, 56 that are sandwiched between the overlapping front wall portions 22*a*, 22*b*.

It will be understood that each of the elements described above, or two or more together, also may find a useful application in other types of constructions differing from the types described above.

While the invention has been illustrated and described as embodied in a transport/display package, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A package convertible from a transport condition to a display condition, comprising:

a) an upright, generally planar, back wall;

b) a pair of generally planar, top and bottom walls extending in mutual parallelism along a longitudinal direction away from the back wall, said bottom wall being longer than the top wall;

c) a pair of upright, generally planar, side walls extending between the top and bottom walls in mutual parallelism along a transverse direction generally perpendicular to the longitudinal direction;

d) an inclined, generally planar, front wall extending between the side walls, and also extending from the bottom wall at an acute angle of inclination in a direction generally toward the back wall and the top wall, said front wall terminating short of the top wall to bound a front opening; and e) a cover having a bottom part at least partly overlying the bottom wall in the transport condition, a front part overlying the front opening and the front wall in the transport condition, and a detachable top part generally co-planar with the top wall in the transport condition and detached from the top wall to form a top opening in the display condition, said cover being removable from the package to expose both the top and front openings.

2. The package according to claim 1, wherein the package is constituted of corrugated board.

3. The package according to claim 1, wherein the top part is connected to the top wall along a discontinuous score line.

4. The package according to claim 1, wherein the bottom, front and top parts are integrally hinged.

5. The package according to claim 1, wherein the angle of inclination lies in a range from about 50° to about 80°.

6. The package according to claim 1, wherein the bottom wall has a pair of slots, and wherein the bottom part has a pair of flaps that are inserted and frictionally held in the slots in the transport condition.

7. The package according to claim 1, wherein the bottom part has a finger notch to facilitate removal of the cover.

8. The package according to claim 1, wherein the bottom wall has a slit, and therein the front wall has a fold about which a pair of front wall portions are folded, one of the front wall portions having a projection for insertion into the slit.

* * * * *